US007850534B2

(12) United States Patent
Smith

(10) Patent No.: US 7,850,534 B2
(45) Date of Patent: Dec. 14, 2010

(54) INFLATABLE GAME TABLE

(76) Inventor: Karen L. Smith, Unit L, 7790 W. 87th Dr., Arvada, CO (US) 80005

( * ) Notice: Subject to any disclaimer, the term of this patent is extended or adjusted under 35 U.S.C. 154(b) by 255 days.

(21) Appl. No.: 11/814,670

(22) PCT Filed: Jan. 24, 2006

(86) PCT No.: PCT/US2006/002410

§ 371 (c)(1),
(2), (4) Date: Jun. 10, 2008

(87) PCT Pub. No.: WO2006/079058

PCT Pub. Date: Jul. 27, 2006

(65) Prior Publication Data

US 2008/0318697 A1 Dec. 25, 2008

Related U.S. Application Data

(60) Provisional application No. 60/645,753, filed on Jan. 24, 2005.

(51) Int. Cl.
*A63D 13/00* (2006.01)
*A63D 15/00* (2006.01)

(52) U.S. Cl. ..... 473/15; 473/4

(58) Field of Classification Search ..... 473/15, 473/4, 9, 415, 466, 496; 273/309; 108/25, 108/27, 42, 43; D21/334, 365, 803; D6/406.5, D6/406.6, 484
See application file for complete search history.

(56) References Cited

U.S. PATENT DOCUMENTS

| | | | | | |
|---|---|---|---|---|---|
| 5,005,702 | A * | 4/1991 | Davis et al. | 206/562 |
| 5,134,930 | A * | 8/1992 | Mei-Hwa | 100/42 |
| 5,492,300 | A * | 2/1996 | Riihiluoma et al. | 248/354.1 |
| 5,570,544 | A * | 11/1996 | Hale et al. | 52/2.18 |
| 5,720,678 | A * | 2/1998 | Korthauer | 473/415 |
| 5,772,535 | A * | 6/1998 | Murphy | 473/415 |
| D405,291 | S * | 2/1999 | Yu | D6/406.5 |
| 5,906,373 | A * | 5/1999 | Sanders | 273/349 |
| 6,296,580 | B1 * | 10/2001 | Hamet | 473/415 |
| 6,442,962 | B1 * | 9/2002 | Gaetke et al. | 62/457.6 |
| D472,585 | S * | 4/2003 | Freedman et al. | D21/334 |
| 6,748,892 | B1 * | 6/2004 | Rochfort | 114/266 |
| 6,823,801 | B2 * | 11/2004 | Lieberman | 108/25 |
| 7,223,185 | B2 * | 5/2007 | Miller et al. | 473/415 |
| 7,300,104 | B1 * | 11/2007 | Hagedorn | 297/158.3 |
| 7,516,960 | B1 * | 4/2009 | Battiste | 273/342 |
| D592,268 | S * | 5/2009 | Montagnino | D21/803 |
| 2004/0106479 | A1 * | 6/2004 | James | 473/415 |
| 2004/0177799 | A1 * | 9/2004 | Andersson et al. | 114/382 |
| 2008/0265510 | A1 * | 10/2008 | Howland | 273/309 |

* cited by examiner

*Primary Examiner*—Mitra Aryanpour
(74) *Attorney, Agent, or Firm*—William H. Holt

(57) ABSTRACT

An inflatable game table (10) constructed of flexible, air impervious panels (22) for forming an inflatable enclosure having an upper playing surface for use as a pool table or the like and being capable of resisting inclement, outdoor weather. The game table (10) is inflatable to a condition for use, and can be deflated for compact storage and transport.

11 Claims, 2 Drawing Sheets

INFLATABLE GAME TABLE

This invention relates to a table for playing the games of pool, billiards or snooker, or the like, and more particularly to a novel, pneumatically, inflatable table which can be inflated and deflated to provide for easy storage and/or transport, and is preferably constructed of material such as waterproof rubber and/or vinyl to allow for indoor or outdoor use during parties or picnics, or at the beach, or similar outings.

SUMMARY OF THE INVENTION

The novel game table is comprised of a generally hollow bladder of air-mattress like construction wherein the side walls, end walls, top and bottom panels are formed of flexible rubber or vinyl material which is rendered impervious to air so that, upon being inflated, an upright, generally rectangular device in the form of a table is formed. A top, planar member is integral with the uppermost portion of the device to provide a level, horizontally disposed, playing surface upon which a set of conventional pool balls, billiard balls or snooker balls can be used to play respective games.

The game table may be, preferably, provided with six standard pockets located in a conventional manner but such pockets can be omitted, or covered, if the game table is to be used, for example, to play the game referred to as billiards. Likewise, a removable insert may be provided to fashion a smaller pocket opening required for playing snooker.

Suitable support straps, preferably of nylon, are used in combination with conventional hook and loop fasteners for securing adjacent straps together to provide adjustability for increasing stability of the table when in its inflated condition.

DETAILED DESCRIPTION OF THE INVENTION

Figure 1:
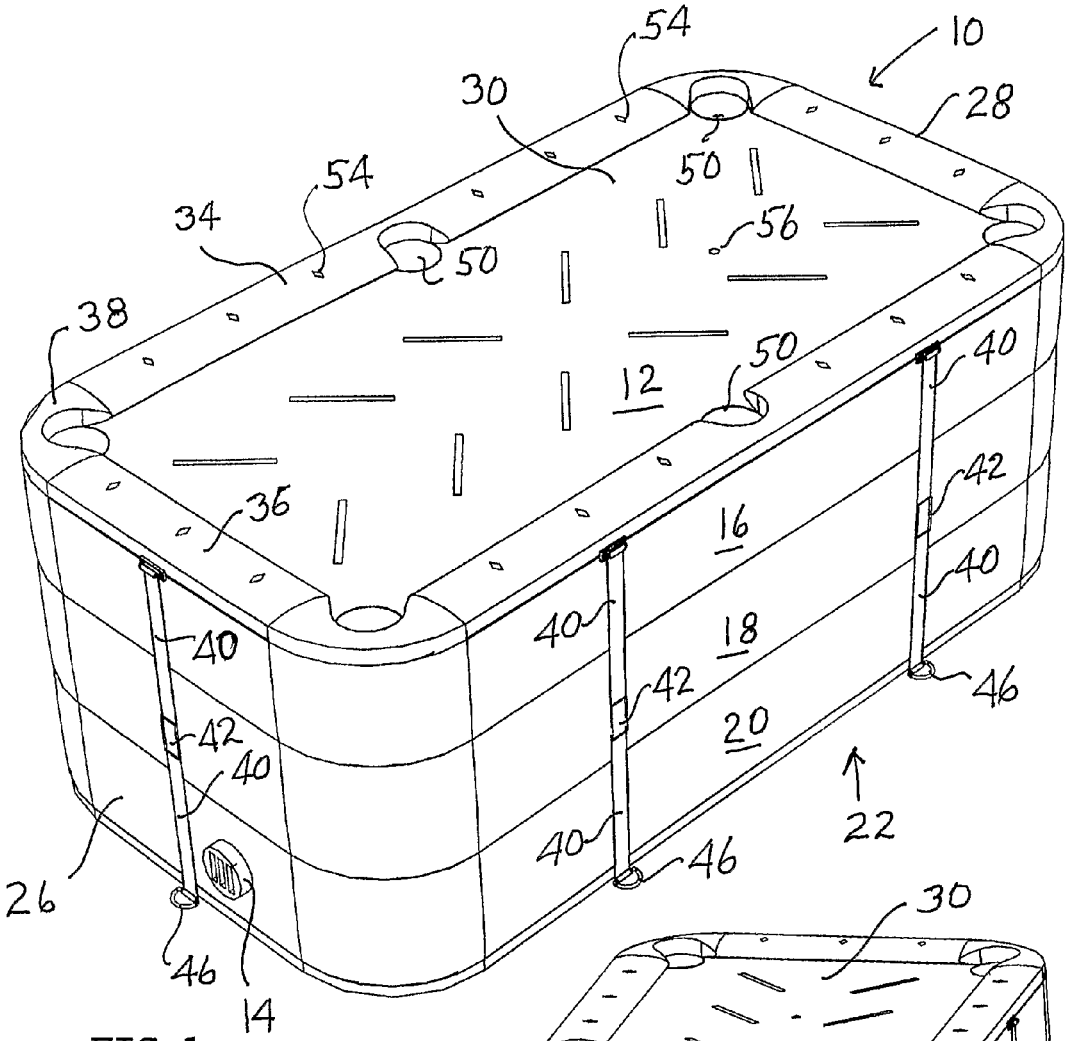
FIG. 1 is a perspective view of the inflated game table in accordance with the present invention.

FIG. 1 is a perspective view of an inflatable game table, generally indicated by the numeral 10, shown in inflated form and having a flat playing surface 12 for supporting a series of conventional game balls (not shown), preferably of standard weights and sizes, but may be of other than standard weight and size, for use in playing games known as billiards, pool or pocket billiards, or snooker, and the like. Thus, It is to be understood that table 10 may be used for playing pocket pool, or snooker and, by enclosing or eliminating the shown six pockets, a modified game table is amenable to being used for the game known as billiards which is played on a surface that does not contain pockets.

Table 10 is essentially a hollow, hermetically sealed, enclosure and is provided with a battery operated pump/motor 14, of a type known for inflating air mattresses and the like, for inflating and deflating the table 10 between an erected condition and a collapsed condition (not shown). The pump/motor 14 IS adapted to be operated from battery power, such as four D-batteries, or a 12-volt system of an automobile, operating through the conventional cigarette lighter.

Table 10 is essentially a hollow, hermetically sealed, enclosure and is provided with a battery operated pump/motor 14, of a type known for inflating air mattresses and the like, for inflating and deflating the table 10 between an erected condition and a collapsed condition (not shown). The pump or motor 14 is adapted to be operated from battery power, such as four D-batteries, or a 12-volt system of an automobile, operating through the conventional cigarette lighter.

A series of straps 40, preferably of nylon, are secured to table 10 at spaced locations about the periphery thereof for providing for stability and leveling of table 10. Straps 40 are provided with hook and loop fasteners 42 for making adjustment in tension and the like. A series of buckles, or metal loops, 46 are provided at the ends of straps 40 and used in combination with known tent pegs, or stakes, (not shown) for securing the table 10 to the earth when it is to be used in an outside environment.

The top panel 30 and the bottom panel 32 enclose the table 10 and are preferably constructed of rubber, or vinyl, or the like, having a thickness on the order of 8.5 millimeters (0.33 inches. for providing extended life in an out-of-door environment, where the table 10 is exposed to possibly inclement weather. The panels 30 and 32 are constructed of a somewhat heavier gauge material than the flexible and collapsible panel members 16; 18 and 20 which may have a thickness of about 5.5 mm (0.22 inches), sufficient for withstanding the pneumatic pressure needed for expanding table 10 to its expanded, upright configuration. Top panel 30 maybe treated with a flocked material to provide a velvet-like, or felt, surface which will withstand inclement, outside weather when table 10 is in use or allowed to remain outside at picnics, or on exposed decks, and the like.

Table 10, in the form of a conventional pool table, is provided with a series of six pockets 50 which are formed of the same rubber or vinyl material as table 10, and are recessed, therein and held in place by straps 52 affixed to bottom panel 32. Table 10 is also provided with traditional markings or diamonds 54, and spot 56, all of which are conventional and well known.

Figure 2:
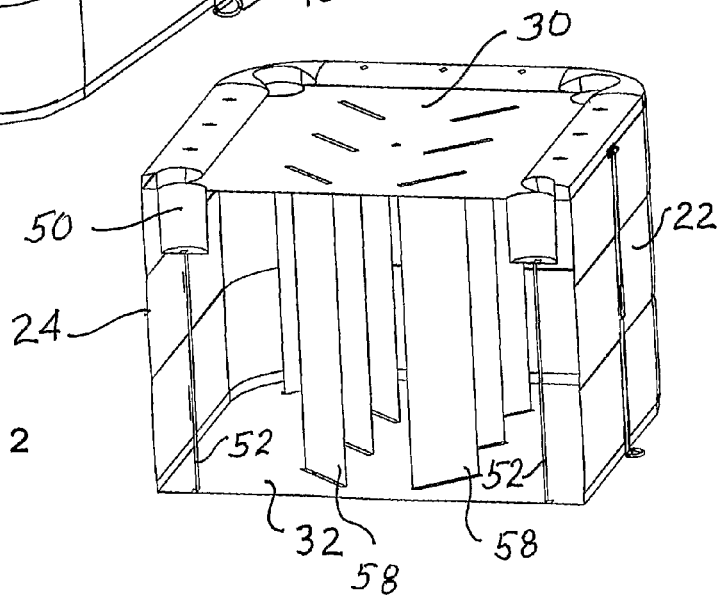
FIG. 2 is a fragmentary, perspective view of a vertical section taken along a transverse plane across the central portion of the game table.
Figure 3:
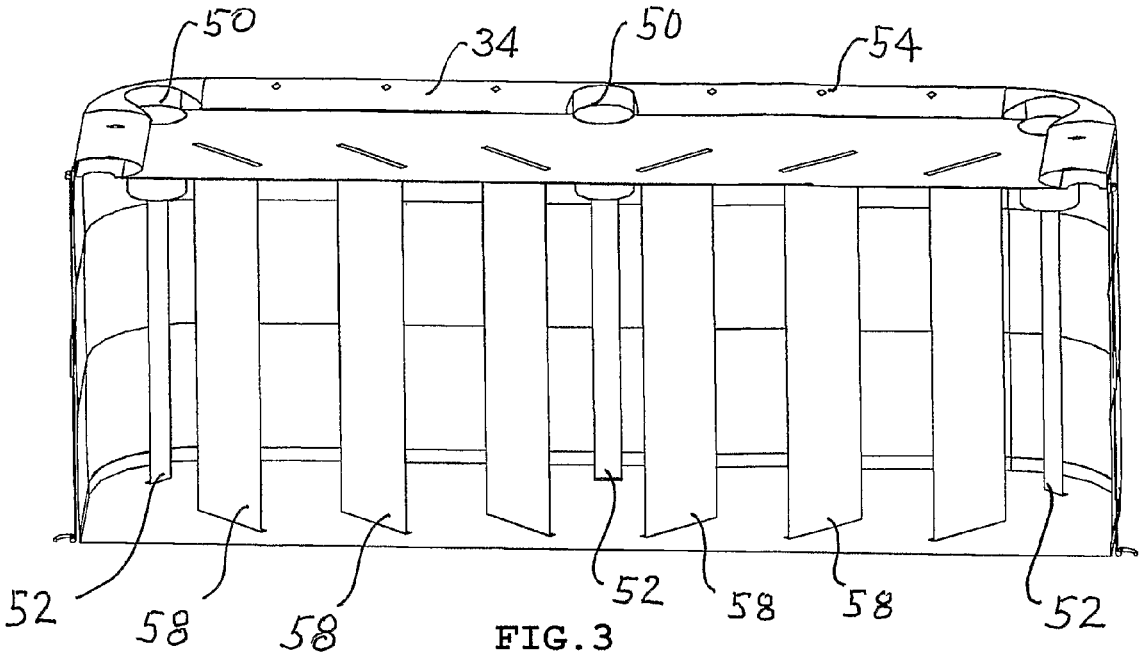
FIG. 3 is a fragmentary, perspective view of a vertical section taken along a longitudinal plane located midway of the transverse width of the game table.
Figure 4:
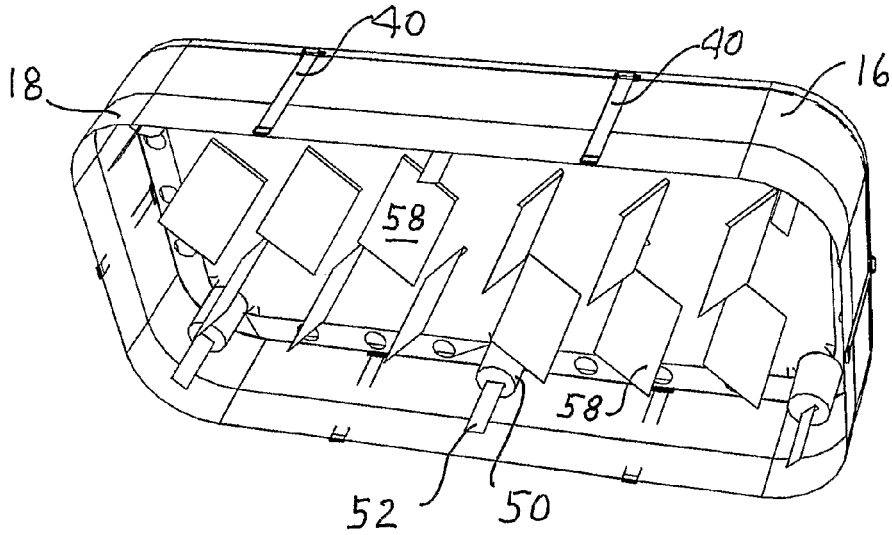
FIG. 4 is a fragmentary, perspective view of an interior of the game table taken along a horizontal plane midway of the height of the game table and looking upwardly toward the underside of the playing surface.

As is shown in FIGS. 2, 3 and 4, table 10 is provided with a plurality of flexible rubber sheets 58 that are adhered to and between the top panel 30 and the bottom panel 32 so that, in the inflated condition of table 10, the top panel can not bulge upwardly and therefore the top playing surface is, surprisingly, maintained in a flat, horizontal condition. In FIGS. 2 and 3, the orientation of the sheets 58 is shown in phantom lines upon the playing surface, but it is to be understood that these lines are not seen in the table, as constructed.

The foregoing description relates to the best mode presently known for constructing the game table 10 but it is to be understood that various modifications and enhancements may be made by persons skilled in the art without departing from the spirit and scope of the invention as defined in the appended claimed subject matter.

I claim:

1. An inflatable game table comprising a top panel having a flat playing surface, said flat playing surface including a plurality of pocket members recessed below said playing surface, a plurality of flexible panel members circumscribing said top panel and depending therefrom for providing side and end portions, a bottom panel adhered to a lower edge of said side and end portions for completing a hermetically closed enclosure; a pump or motor for inflating and deflating said enclosure between an inflated, upright condition during use, and a deflated condition for storage or transport; and each of said plurality of pocket members having a strap connected at a bottom portion and extending to said bottom panel for retaining said plurality of pocket members recessed below said playing surface when said table inflated.

2. A game table as defined in claim 1 including a series of straps secured about said side and end portions, said straps including hook and loop fastening means for providing adjustable means for adjustably tensioning said straps.

3. A game table as defined in claim 1 including a series of molded rail members circumscribing said top panel for providing rigidity to said game table.

4. A game table as defined in claim 1 including a plurality of flexible sheets adhered to the underside of said top panel and the upper side of said bottom panel for precluding bulging of said playing surface when said table is in an inflated condition.

5. A game table as defined in claim 1 including a plurality of loops secured at spaced intervals along a bottom periphery of said table and providing means for attaching said table against displacement.

6. An inflatable game table comprising:

a top panel having a flat playing surface usable for the games of billiards, pool and snooker, a plurality of flexible panel members circumscribing said top panel and depending therefrom for providing side and end portions, a bottom panel adhered to a lower edge of said side and end portions for completing a hermetically closed enclosure;

a pump or motor for inflating and deflating said enclosure between an inflated, upright condition during use, and a deflated condition for storage or transport; and including a series of straps secured about said side and end portions, said straps including means for adjustably tensioning said straps for providing stability and leveling of said flat playing surface.

7. A game table as defined in claim 6 including a series of molded rail members circumscribing said top panel for providing rigidity to said game table.

8. A game table as defined in claim 6 including a plurality of pocket members recessed below said playing surface, and a plurality of straps connected between said plurality of pocket members and said bottom panel for retaining said pocket members recessed below said playing surface when said table is inflated.

9. A game table as defined in claim 6 including a plurality of flexible sheets adhered to the underside of said top panel and the upper side of said bottom panel for precluding bulging of said playing surface when said table is in an inflated condition.

10. A game table as defined in claim 6 including a plurality of loops secured at spaced intervals along a bottom periphery of said table and providing means for attaching said table against displacement.

11. A game table as defined in claim 6 including a plurality of removable inserts for covering the plurality of pocket members.

* * * * *